US011805825B2

(12) United States Patent
Ichigaya et al.

(10) Patent No.: US 11,805,825 B2
(45) Date of Patent: Nov. 7, 2023

(54) FAN DEVICE, FAN-EQUIPPED GARMENT, AND RECORDING MEDIUM

(71) Applicant: SFT LABORATORY CO., LTD., Tokyo (JP)

(72) Inventors: Hiroshi Ichigaya, Tokyo (JP); Toru Ichigaya, Tokyo (JP); Yohei Oki, Tokyo (JP); Naoki Inoue, Tokyo (JP); Naokatu Furuya, Tokyo (JP); Yasuhiro Kawakubo, Tokyo (JP); Hidehito Nakanishi, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 0 days.

(21) Appl. No.: 17/696,118

(22) Filed: Mar. 16, 2022

(65) Prior Publication Data

US 2022/0295917 A1 Sep. 22, 2022

(30) Foreign Application Priority Data

Mar. 19, 2021 (JP) ..... 2021-045827

(51) Int. Cl.

| | |
|---|---|
| ***A41D 13/002*** | (2006.01) |
| ***F04D 27/00*** | (2006.01) |
| ***F04D 25/08*** | (2006.01) |
| ***F04D 25/06*** | (2006.01) |

(52) U.S. Cl.

CPC ..... *A41D 13/0025* (2013.01); *F04D 25/0673* (2013.01); *F04D 25/08* (2013.01); *F04D 27/00* (2013.01)

(58) Field of Classification Search

CPC ..... F04D 25/08; F04D 27/00; F04D 25/0673; A41D 13/0025

See application file for complete search history.

(56) References Cited

FOREIGN PATENT DOCUMENTS

| | | | |
|---|---|---|---|
| JP | 6763007 B2 | * | 9/2020 |
| JP | 6763007 B2 | | 9/2020 |
| JP | 2020193397 A | * | 12/2020 |

OTHER PUBLICATIONS

Machine Translation of JP6763007B2 PDF file name: "JP6763007B2_Machine_Translation.pdf."*

Machine Translation of JP2020193397A PDF file name: "JP2020193397A_Machine_Translation.pdf."*

* cited by examiner

*Primary Examiner* — Grant Moubry
*Assistant Examiner* — Ruben Picon-Feliciano
(74) *Attorney, Agent, or Firm* — Holtz, Holtz & Volek PC

(57) ABSTRACT

A fan device that can be attached to a garment body includes a fan, a drive, an operation interface, and a controller. The drive rotates the fan. The operation interface is for a user to switch drive status of the drive. The controller switches the drive status of the drive based on operation on the operation interface by the user. The operation interface includes a first switch and a second switch. The first switch is for switching an air volume of the fan between air volumes of multiple modes. The second switch is for switching a mode to a first mode in which the air volume of the fan is a first air volume which is larger than air volumes that are switched by the first switch.

10 Claims, 8 Drawing Sheets

| | FIRST MODE | SECOND MODE | THIRD MODE | FOURTH MODE | FIFTH MODE |
|---|---|---|---|---|---|
| APPLIED VOLTAGE | 15V | 12V | 10V | 8V | 5V |
| AIR VOLUME | 65L/ min | 52L/ min | 45L/ min | 36L/ min | 23L/ min |

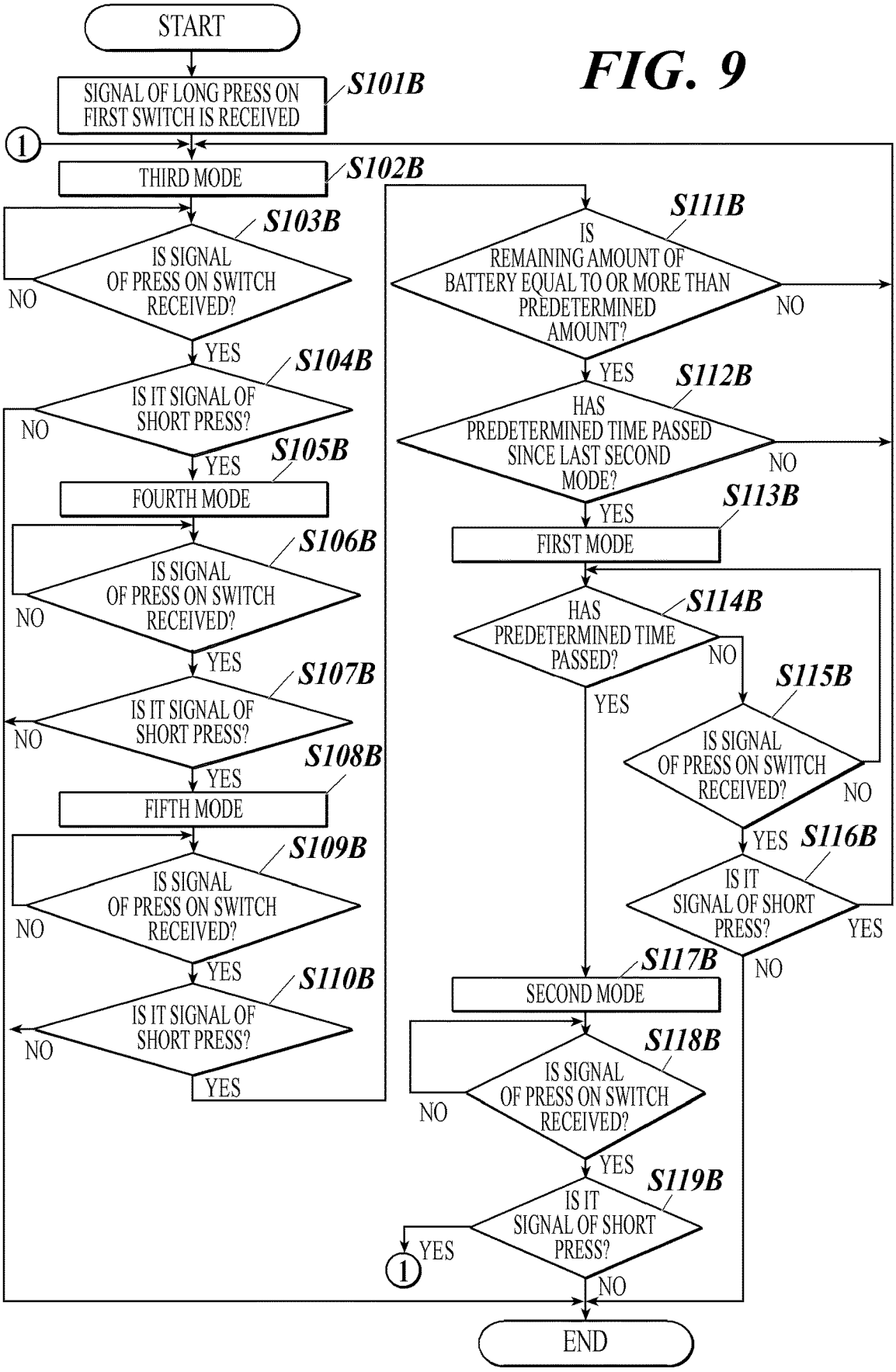
FIG. 9
START
SIGNAL OF LONG PRESS ON FIRST SWITCH IS RECEIVED
S101B
1
THIRD MODE
S102B
S103B
IS SIGNAL OF PRESS ON SWITCH RECEIVED?
NO
YES
S104B
IS IT SIGNAL OF SHORT PRESS?
NO
YES
S105B
FOURTH MODE
S106B
IS SIGNAL OF PRESS ON SWITCH RECEIVED?
NO
YES
S107B
IS IT SIGNAL OF SHORT PRESS?
NO
YES
S108B
FIFTH MODE
S109B
IS SIGNAL OF PRESS ON SWITCH RECEIVED?
NO
YES
S110B
IS IT SIGNAL OF SHORT PRESS?
NO
YES
S111B
IS REMAINING AMOUNT OF BATTERY EQUAL TO OR MORE THAN PREDETERMINED AMOUNT?
NO
YES
S112B
HAS PREDETERMINED TIME PASSED SINCE LAST SECOND MODE?
NO
YES
S113B
FIRST MODE
S114B
HAS PREDETERMINED TIME PASSED?
NO
YES
S115B
IS SIGNAL OF PRESS ON SWITCH RECEIVED?
NO
YES
S116B
IS IT SIGNAL OF SHORT PRESS?
YES
NO
S117B
SECOND MODE
S118B
IS SIGNAL OF PRESS ON SWITCH RECEIVED?
NO
YES
S119B
IS IT SIGNAL OF SHORT PRESS?
YES
1
NO
END

FAN DEVICE, FAN-EQUIPPED GARMENT, AND RECORDING MEDIUM

CROSS REFERENCE TO RELATED APPLICATION

This application is based upon and claims the benefit of priority under 35 USC 119 of Japanese Patent Application No. 2021-45827 filed on Mar. 19, 2021, the entire disclosure of which, including the description, claims, drawings and abstract, is incorporated herein by reference in its entirety.

BACKGROUND

1. Technical Field

The invention relates to a fan device, a fan-equipped garment, and a recording medium.

2. Description of Related Art

Recently, known fan-equipped garments are equipped with fan devices that lower the body temperature of a user through vaporization heat by sending air. Drive modes of the fan device can be switched. Varying the air volume facilitates adjustment of the temperature.

However, in such a fan-equipped garment, continuation of a drive mode with large air volume for a long time is not desirable because it may cause excessive cooling and drying of skin near the fan device.

Therefore, a known fan-equipped garment automatically switches the drive mode to a mode right before the drive mode with large air volume if the drive mode with large air volume continues for a long time (e.g., Japanese Patent No. 6763007).

However, such a fan device has multiple drive modes. Therefore, the air volume may be different every time the drive mode is switched to a mode right before the drive mode with large air volume. This sometimes gives a user a sense of discomfort.

SUMMARY OF INVENTION

The purpose of the present invention is to provide a fan device, a fan-equipped garment, and a recording medium that do not give a user any discomfort when an air volume is automatically decreased while keeping ease of temperature adjustment.

To achieve at least one of the above-mentioned objects, according to an aspect of the present invention, a fan device that can be attached to a garment body includes:

a fan;

a drive that rotates the fan;

an operation interface for a user to switch drive status of the drive; and a controller that switches the drive status of the drive based on operation on the operation interface by the user, wherein the operation interface includes:

a first switch for switching an air volume of the fan between air volumes of multiple modes; and a second switch for switching a mode to a first mode in which the air volume of the fan is a first air volume which is larger than air volumes that are switched by the first switch, and when the second switch is operated, the controller makes the drive operate in the first mode, and after a predetermined period, the controller makes the drive operate in a second mode in which the air volume of the fan is a second air volume which is smaller than the first air volume and which is different from the air volumes that are switched by the first switch.

Preferably, the first switch also serves as a power switch.

Preferably, the controller invalidates input to the second switch while making the drive operate in the first mode.

According to another aspect of the present invention, a fan device that can be attached to a garment body includes:

a fan;

a drive that rotates the fan;

an operation interface for a user to switch drive status of the drive; and a controller that switches the drive status of the drive based on operation on the operation interface by the user, wherein the operation interface includes a switch for switching an air volume of the fan between air volumes of multiple modes, and when a mode is switched by the switch to a first mode in which the air volume of the fan is a first air volume which is maximum, the controller makes the drive operate in the first mode, and after a predetermined period, the controller makes the drive operate in a second mode in which the air volume of the fan is a second air volume which is smaller than the first air volume and which is different from the air volumes of the multiple modes which are switched.

Preferably, the multiple modes include a fluctuation mode in which the air volume of the fan is alternated between a third air volume and a fourth air volume that is smaller than the third air volume.

Preferably, the drive comprises a battery, and when the mode is switched to the first mode, the controller makes the drive operate in the first mode in a case where a remaining amount of the battery is more than or equal to a predetermined amount.

Preferably, when the mode is switched to the first mode, the controller makes the drive operate in the first mode again in a case where a predetermined time has passed since end of last control operation of the drive in the first mode.

According to another aspect of the present invention, a fan-equipped garment includes:

the fan device according to claim 1; and the garment body to which the fan device is detachably attached.

According to still another aspect of the present invention, a non-transitory recording medium stores a program for a computer of a fan device that can be attached to a garment body, wherein:

the fan device includes:

a fan;

a drive that rotates the fan;

an operation interface for a user to switch drive status of the drive; and a controller that switches the drive status of the drive based on operation on the operation interface by the user, the operation interface includes:

a first switch for switching an air volume of the fan between air volumes of multiple modes; and a second switch for switching a mode to a first mode in which the air volume of the fan is a first air volume which is larger than air volumes that are switched by the first switch, and the program causes the computer to:

make the drive operate in the first mode in a case where the second switch is operated, and after a predetermined period, make the drive operate in a second mode in which the air volume of the fan is a second air volume which is smaller than the first air volume and which is different from the air volumes that are switched by the first switch.

According to still another aspect of the present invention, a non-transitory recording medium stores a program for a computer of a fan device that can be attached to a garment body, wherein:

the fan device includes:

a fan;

a drive that rotates the fan;

an operation interface for a user to switch drive status of the drive; and a controller that switches the drive status of the drive based on operation on the operation interface by the user, the operation interface includes a switch for switching an air volume of the fan between air volumes of multiple modes, and the program causes the computer to:

make the drive operate in a first mode in which the air volume of the fan is a first air volume which is maximum in a case where a mode is switched by the switch to the first mode, and after a predetermined period, make the drive operate in a second mode in which the air volume of the fan is a second air volume which is smaller than the first air volume and which is different from the air volumes of the multiple modes which are switched.

The present invention provides a fan device, a fan-equipped garment, and a recording medium that does not give a user any discomfort when an air volume is automatically decreased while keeping ease of temperature adjustment.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 9 is a flowchart showing switching of drive status of a drive when a switch is pressed in the fan device of the third embodiment.

DETAILED DESCRIPTION OF EMBODIMENTS

The invention will be explained in detail with reference to the drawings. The embodiments described below have various technically preferable limitations for carrying out the invention. The scope of the claims of the application is not limited to those embodiments and examples shown in figures.

Overall Configuration

Figure 1:
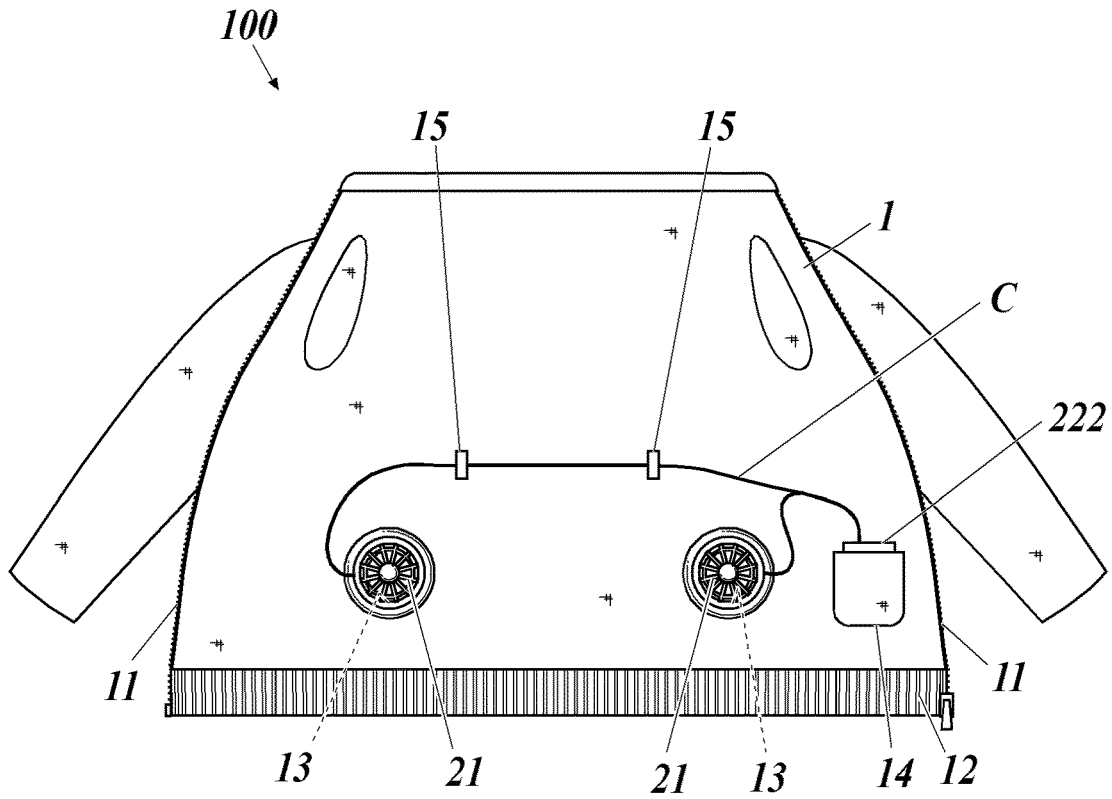
FIG. 1 is a front view of the first embodiment of a fan-equipped garment with a fastener being opened.

As shown in FIG. 1, the fan-equipped garment 100 according to the first embodiment includes:

a garment body 1; and a fan device 2 with a fan 21 that introduces air into the garment body 1.

Outside air drawn into the garment body 1 by the fan device 2 is distributed along the surface of a user's body or underwear, and then discharged from a collar and sleeves of the garment body. It evaporates sweat on the body. The heat of vaporization cools the body.

Garment Body

The garment body 1 is, for example, a blouson type as shown in FIG. 1.

The garment body 1 includes:

a fastener 11 that opens and closes the front of the garment body 1;

an air seal 12 that prevents air between the garment body 1 and a user from leaking through the hem;

a fan mount hole 13 where a fan 21 (described later) can be detachably mounted;

a battery holder 14 that can hold a battery 222 (described later); and a cable holder 15 that can hold a cable C connecting the fan 21 and the battery 222.

The garment body 1 is formed by a sheet material. The sheet material is either non-breathable or breathable to the extent that it can be inflated by introduction of outside air by the fan device 2. The fan device 2 can be attached to the garment body 1. Other configurations of the garment body 1 can be freely determined.

Fan Device

Figure 2:
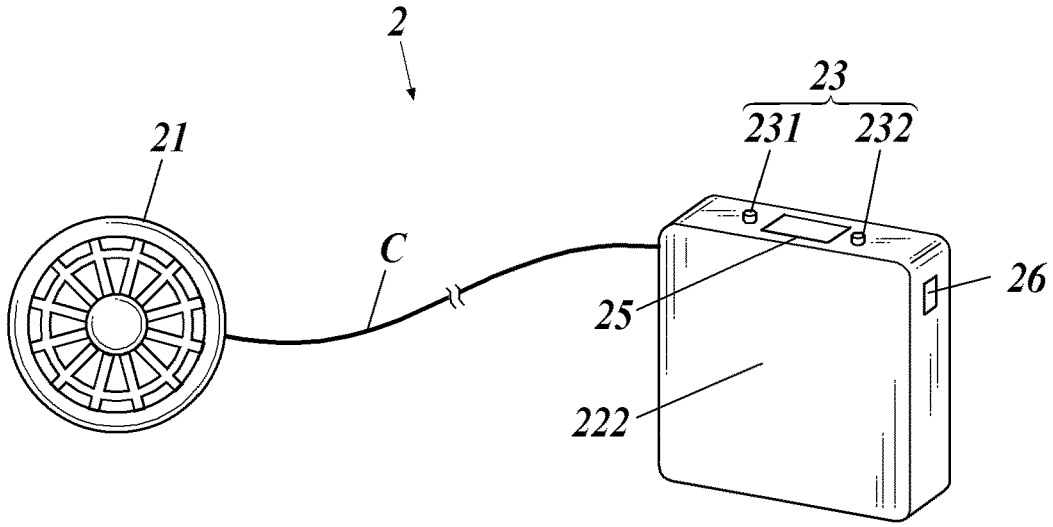
FIG. 2 shows a schematic diagram of a fan device of the first embodiment.
Figures 3, 4:
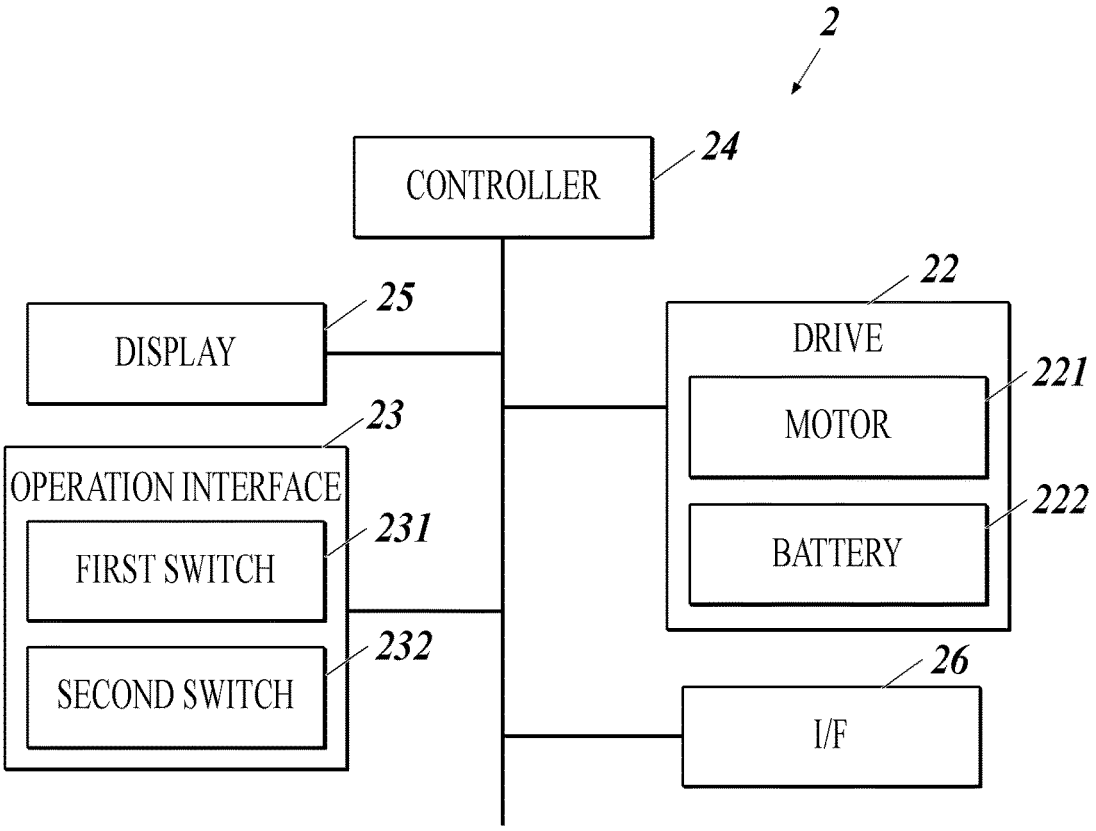
FIG. 3 shows a block diagram of functions of the fan device of the first embodiment.
FIG. 4 is a table showing a voltage applied to a motor and an air volume of a fan in each mode in the fan device of the first embodiment.

As shown in FIG. 2 and FIG. 3, the fan device 2 includes:

a fan 21 that draws outside air into the garment body 1;

a drive 22 that drives the fan 21;

an operation interface 23 that inputs a signal to switch drive status of the drive 22;

a controller 24 that controls switching of the drive status of the drive 22 in response to signals received from the operation interface 23;

a display 25 that shows the drive status of the drive 22; and an I/F (interface) 26 for connecting the device to the fan 21 via the cable C, etc. or to an external power source.

Fan

The fan 21 includes, for example, a propeller (not shown) housed in a case. The fan 21 is detachably mounted in the fan mount hole 13. The fan 21 can have any specific configuration as long as it can draw outside air into the garment body 1. FIG. 1 shows a configuration where one fan device 2 has two fans 21, but the fan device 2 is not limited to this. One fan device 2 may have only one fan 21 as shown in FIG. 2, or may have more than two fans 21.

Drive

The drive 22 is a component that drives the fan 21.

For example, the drive 22 includes:

a motor 221;

a transmission mechanism (not shown) that transmits a rotational force of the motor 221 to the propeller; and a battery 222 that applies a voltage necessary to drive the motor 221.

Operation Interface

The operation interface 23 is, for example, a switch on the outer surface of the drive 22.

The operation interface 23 includes the first switch 231 and the second switch 232.

First Switch

The first switch 231 is a switch that switches a mode (described later) of the drive 22 and is also a power switch that turns on/off the drive 22.

Specifically, when a user presses the first switch 231 for a time less than predetermined seconds (e.g., two seconds), the mode of the drive 22 is switched. When a user presses the power switch 231 for a time longer than or equal to the predetermined seconds, the drive 22 is turned on or off.

In the following, switch operation to switch the mode of the drive 22 will be referred to as "short press". Switch operation on the first switch 231 to turn on/off the drive 22 is referred to as "long press".

Second Switch

The second switch 232 is a switch that switches the mode of the drive 22 to the first mode (described later).

When the second switch 232 is pressed, the mode is switched to the first mode in a case where:

the drive 22 is on;

the remaining amount of the battery 222 is larger than or equal to a predetermined amount (e.g., 60% or more); and a predetermined time (e.g., 30 minutes) has passed since the last time the system was switched from the first mode to the second mode.

The drive 22 is not turned on/off in a case where the drive 22 is off. The mode is not switched in a case where the second switch 232 is pressed when the fan device 2 is already in the first mode.

Controller

The controller 24 includes:

a CPU (central processing unit);

RAM (random access memory) including non-volatile memory;

ROM (read only memory) in which a determination program, setting data, etc. are stored; and a timer.

The controller 24 performs central control for components of the fan device 2.

Specifically, the controller 24 switches the drive status of the drive 22 and display of the display 25 according to:

a current drive status of the drive 22; and a signal input from the operation interface 23.

When the drive 22 is automatically switched from the first mode to the second mode, the controller 24 starts counting with the timer from that point. After a predetermined time (e.g., 30 minutes), the controller 24 sets a flag of passage of standby time. Counting by the timer continues even while the drive 22 is off.

Display

The display 25 is, for example, a seven-segment display. The display 25 displays numbers or alphabets according to the mode of the drive 22 to make a user of the garment body 1 aware of the current mode.

I/F

The I/F 26 includes:

connection terminals for various peripheral devices; and a communicator for sending and receiving signals to and from external devices.

In this embodiment, the I/F 26 is, for example, a DC (direct current) plug in a case. The I/F 26 is connected to an outlet of a commercial power source via an AC (alternating current) adapter. An AC power source power is converted into a DC power source voltage. The battery 222 is charged. The I/F 26 in this embodiment is a connection terminal. The I/F 26 connects the motor 221 with the battery 222 via the cable C. Thereby, the voltage of the battery 222 is applied to the motor 221.

Modes and Switching Thereof

The drive 22 of the fan device 2 of the first embodiment has five modes consisting of the first mode to the fifth mode. For example, the voltages applied to the motor 221 and the air volumes of the fan 21 shown in FIG. 4 are set for the five modes.

As shown in FIG. 4, in this embodiment, the voltage applied to the motor 221 and the air volume of the fan 21 are largest in the first mode. They gradually get smaller, and are smallest in the fifth mode. As long as the applied voltage and air volume for the mode are largest in the first mode and are different between the modes, they can be any values including those in FIG. 4.

First, a signal of long press on the first switch 231 is input, and the drive 22 is turned on. The controller 24 makes the drive 22 operate in the third mode. Every time a signal of short press on the first switch 231 is input, the controller 24 cyclically switches the mode to the fourth mode, the fifth mode, the third mode, and so on. A predetermined period (e.g., 5 minutes) after a signal of press on the second switch 232 by a user was input and the drive 22 was driven in the first mode, the controller 24 automatically switches the mode to the second mode and makes the drive 22 operate. When the signal of short press on the first switch 231 by a user is input while the mode is the first or second mode, the controller 24 switches the mode of the drive 22 to the third mode.

Flow of Switching of Drive Status when First Switch is Pressed

Figure 5:
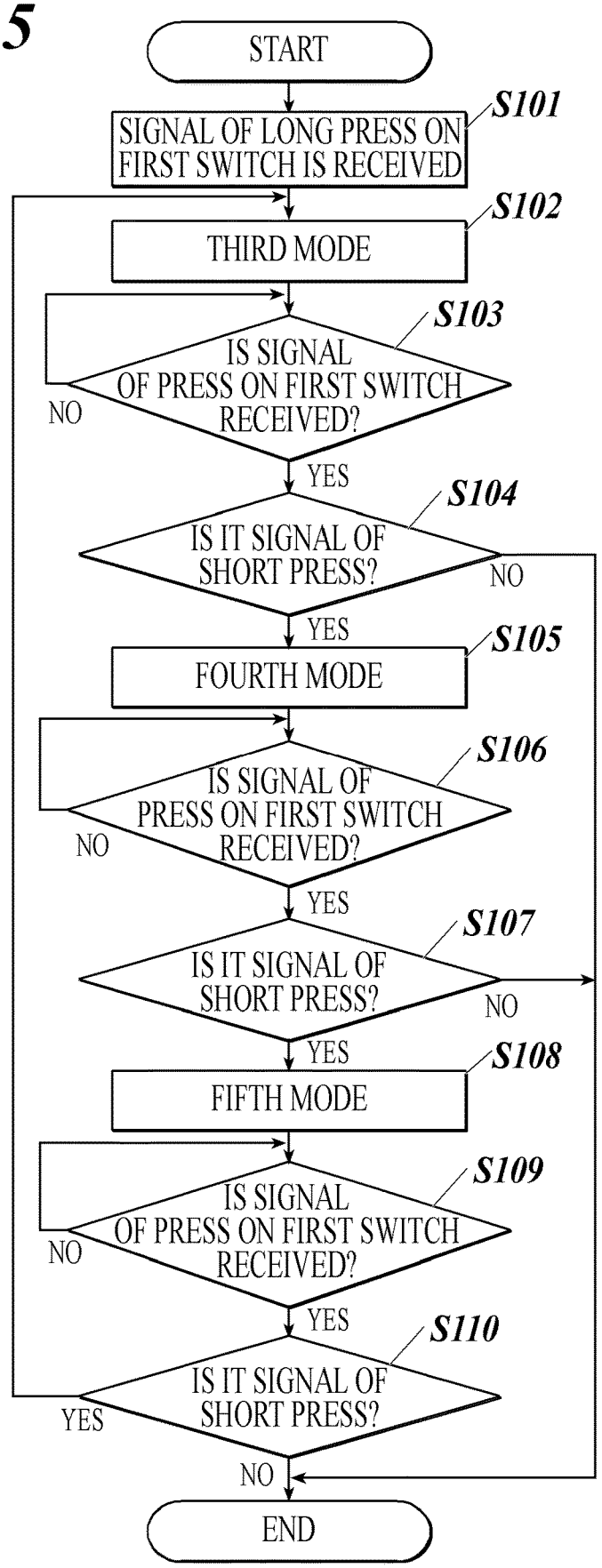
FIG. 5 is a flowchart showing switching of drive status of the drive when the first switch is pressed in the fan device of the first embodiment.

FIG. 5 is a flowchart showing switching of the above mentioned modes in the fan device 2 of the first embodiment.

First, the signal of long press on the first switch 231 by a user is input (Step S101), and the controller 24 receives the signal, turns on the drive 22, and makes it operate in the third mode (Step S102).

Next, the controller 24 determines whether a signal of press on the first switch 231 is input (Step S103). If the signal is not input (No in Step S103), the controller 24 makes the drive 22 continue to operate in the third mode until the signal is input.

If the signal is input (Yes in Step S103), the controller 24 determines whether the signal is the signal of short press (Step S104). If the signal is not the signal of short press, i.e., if the signal is the signal of long press (No in Step S104), the controller 24 turns off the drive 22 to terminate operation.

If the signal is the signal of short press (Yes in Step S104), the controller switches the mode of the drive 22 to the fourth mode (Step S105).

Next, the controller 24 determines whether a signal of press on the first switch 231 is input (Step S106). If the signal is not input (No in Step S106), the controller 24 makes the drive 22 continue to operate in the fourth mode until the signal is input.

If the signal is input (Yes in Step S106), the controller 24 determines whether the signal is the signal of short press (Step S107). If the signal is not the signal of short press, i.e., if the signal is the signal of long press (No in step S107), the controller 24 turns off the drive 22 to terminate operation.

If the signal is the signal of short press (Yes in Step S107), the controller 24 switches the mode of the drive 22 to the fifth mode (Step S108).

Next, the controller 24 determines whether a signal of press on the first switch 231 is input (Step S108). If the signal is not input (No in Step S108), the controller 24 makes the drive 22 continue to operate in the fifth mode until the signal is input from the first switch 231.

If the signal is input (Yes in Step S108), the controller 24 determines whether the signal is the signal of short press (Step S109). If the signal is not the signal of short press, i.e., if the signal is the signal of long press (No in step S110), the controller 24 turns off the drive 22 to terminate operation.

If the signal is the signal of short press (Yes in Step S109), the controller 24 switches the mode of the drive 22 to the third mode (Step S102).

As described above, in the fan device 2 of the embodiment, every time a user performs operation to input a signal by pressing the first switch 231, the controller 24 determines whether the signal is the signal of short press or the signal of long press. If the signal is the signal of long press, the controller 24 turns off the drive 22 to terminate operation. If the signal is the signal of short press, the controller 24 cyclically switches the mode of the drive 22 to the third mode, the fourth mode, the fifth mode, the third mode, and so on.

Figure 6:
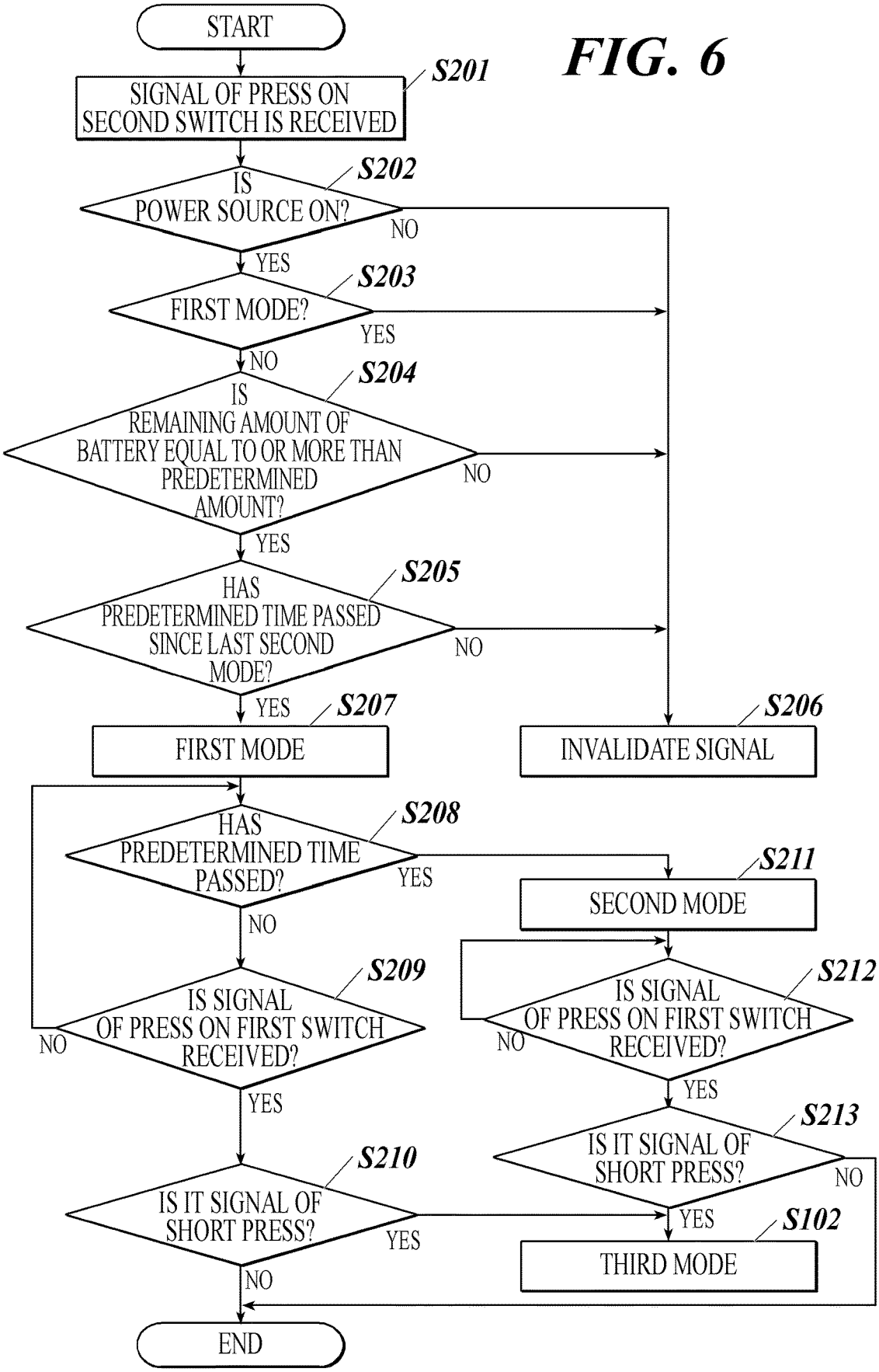
FIG. 6 is a flowchart showing switching of the drive status of the drive when the second switch is pressed in the fan device of the first embodiment.

Flow of Switching of Drive Status when Second Switch is Pressed Next, FIG. 6 shows a flowchart in a case where the second switch 232 is pressed.

First, the signal of press on the second switch 232 by a user is input (Step S201), and the controller 24 determines whether the drive 22 is on (Step S202). If the drive 22 is not on, that is, if the drive 22 is off (No in Step S202), the controller 24 invalidates input of the signal (Step S206).

If the drive 22 is on (Yes in Step S202), the controller 24 determines whether the drive 22 is in the first mode (Step S203). If the driver 22 is in the first mode (Yes in Step S203), the controller 24 invalidates input of the signal and displays an error message on the display 25 (Step S206).

If the drive 22 is not in the first mode (No in Step S203), the controller 24 determines whether the remaining amount of the battery 222 of the drive 22 is more than or equal to a predetermined amount (Step S204). If the remaining amount of the battery 222 is less than the predetermined amount (No in Step S204), the controller 24 invalidates input of the signal and displays an error message on the display 25 (Step S206).

If the remaining amount of the battery 222 is more than or equal to the predetermined amount (Yes in Step S204), the controller 24 determines whether a predetermined time has passed since the last time the mode was switched to the second mode (Step S205). If the predetermined time has not passed (No in Step S205), the controller 24 invalidates input of the signal and displays an error message on the display 25 (Step S206).

If the predetermined time has passed since the last time the mode was switched to the second mode (Yes in Step S205), the controller 24 switches the mode of the drive 22 to the first mode (Step S207). Whether the predetermined time has passed is determined by presence or absence of the flag of passage of standby time.

Next, the controller 24 determines whether a predetermined period has passed since the mode of the drive 22 was switched to the first mode (Step S208). If the predetermined period has not passed (No in Step S208), the controller 24 determines whether a signal of press on the first switch 231 is input (Step S209).

If the signal is not input (No in Step S209), the controller 24 makes the drive 22 continue to operate in the first mode until the predetermined period passes or until the signal is input.

If the signal is input (Yes in Step S209), the controller 24 determines whether the signal is the signal of short press (Step S210). If the signal is not the signal of short press, i.e., if the signal is the signal of long press (No in Step S210), the controller 24 turns off the drive 22 to terminate operation.

If the signal is the signal of short press (Yes in Step S210), the controller 24 switches the mode of the drive 22 to the third mode (Step S102).

If the predetermined period has passed without input of a signal of press on the first switch 231 since the mode of the driver 22 was switched to the first mode (Yes in Step S208), the controller 24 automatically switches the mode of the drive 22 to the second mode (Step S211). At this time, the controller 24 starts counting the predetermined time by the timer.

Next, the controller 24 determines whether a signal of press on the first switch 231 is input (Step S212). If the signal is not input (No in Step S212), the controller 24 makes the drive 22 continue to operate in the second mode until the signal is input.

If the signal is input (Yes in Step S212), the controller 24 determines whether the signal is the signal of short press (Step S213). If the signal is not the signal of short press, i.e., if the signal is the signal of long press (No in Step S213), the controller 24 turns off the drive 22 to terminate operation.

If the signal is the signal of short press (Yes in Step S213), the controller 24 switches the mode of the drive 22 to the third mode (Step S102).

Advantageous Effects of Invention

As shown above, the fan device 2 of the first embodiment includes:

- the fan 21;
- the drive 22 that rotates the fan 21;
- the operation interface 23 for a user to switch the drive status of the drive 22; and
- the controller 24 that switches the drive status of the drive 22 based on operation on the operation interface 23 by a user.

The operation interface 23 includes:

- the first switch 231 for switching the air volume of the fan 21 between air volumes of the several modes; and
- the second switch 232 that can switch the mode to the first mode in which the air volume of the fan 21 is the first air volume.

The first air volume is larger than the air volumes that can be switched by the first switch 231.

When the second switch 232 is operated, the controller 24 drives the drive 22 in the first mode. After the predetermined period, the controller 24 makes the drive 22 operate in the second mode in which the air volume of the fan 21 is the second air volume. The second air volume is smaller than the first air volume and is different from the air volumes that can be switched by the first switch 231.

Thus, when the controller 24 automatically reduces the air volume of the fan 21 after the first mode with the large air volume continues for the predetermined period, the controller 24 does not return the mode to the mode before the first mode (i.e., one of the third to fifth modes). Instead, the controller 24 switches the mode of the drive 22 to the second mode, regardless of the mode before the first mode. The air volume of the second mode is smaller than that of the first mode and is different from the air volumes of the third to fifth modes. This does not give a user any sense of discomfort.

The first switch 231 also serves as a power switch.

This reduces the number of components of the operation interface 23 and lowers the manufacturing cost of the fan device 2.

While the drive 22 operates in the first mode, the controller 24 invalidates input to the second switch 232.

This inhibits erroneous operation by a user.

The drive 22 includes the battery 222. When the mode is switched to the first mode, the controller 24 makes the drive 22 operate in the first mode in the case where the remaining amount of the battery 222 is larger than or equal to the predetermined amount.

Therefore, while the drive 22 operates in the first mode, it can be prevented from being forcibly turned off due to unexpectedly running out of battery 222.

When the mode is switched to the first mode, the controller 24 drives the drive 22 in the first mode again in the case where the predetermined time has passed since the end of the last control operation of the drive 22 in the first mode.

This prevents excessive heat generation in the motor 221 due to continued operation in the first mode.

In FIG. 2, the drive 22, the operation interface 23, and the controller 24 are integrated and are connected to the fan 21 by the cable C. The present invention is not limited to this.

For example, the drive 22 can be an outlet cable extending from the fan 21. By connecting the outlet cable directly to a power source, the fan 21 is driven. In this case, preferably, the fan 21 is equipped with a motor 221 and transmission mechanism, and the drive 22 is separate from the operation interface 23 and the controller 24.

Alternatively, for example, the fan 21, the drive 22, and the controller 24 may be integrated into a single unit, and the drive status of the drive 22 may be switched by operating the operation interface 23 which is a separate remote control or the like to transmit a wireless signal.

Second Embodiment

The fan device 2A of the second embodiment will be explained based on FIG. 7. The same signs are given to the same components as those of the fan device 2 of the first embodiment. Explanation is omitted.

In addition to the first to fifth modes shown in the first embodiment, the fan device 2A of the second embodiment has a fluctuation mode that alternates between the third and fourth modes. It comes to a total of six modes.

In the fluctuation mode, the drive 22 can operate in the third or fourth mode for a time of any length, and switching between the third and fourth modes can be done in a time of any length. For example, the drive time in the fourth mode with a small air volume may be longer than the drive time in the third mode with a large air volume. In this way, even when the fan device 2A is driven in the fourth mode, a user feels that the same amount of air is being blown as in the third mode.

Flow of Switching of Drive Status when First Switch is Pressed

Figure 7:
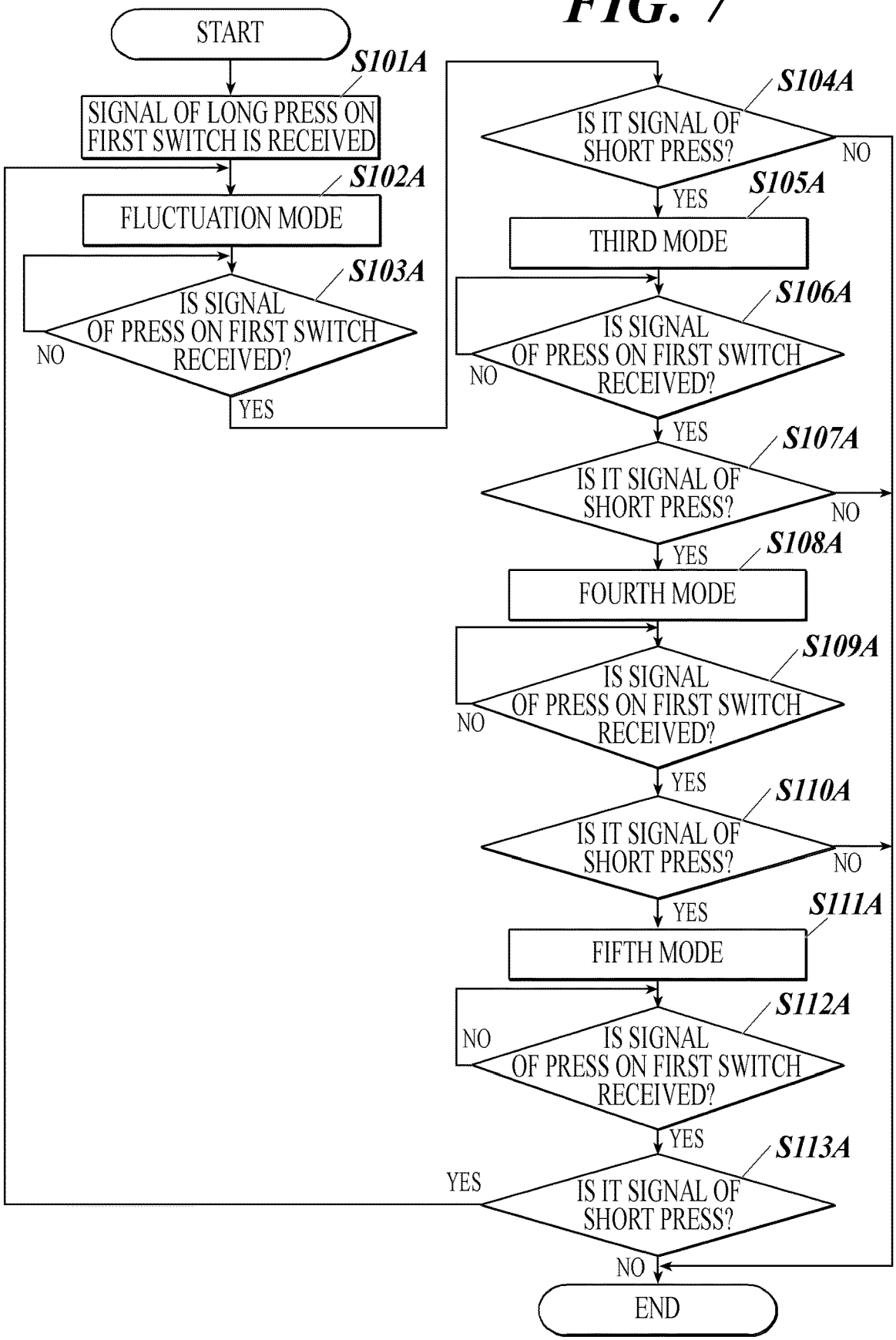
FIG. 7 is a flowchart showing switching of drive status of a drive when the first switch is pressed in a fan device of the second embodiment.

FIG. 7 is a flowchart showing switching of modes in the fan device 2A of the second embodiment.

In the following explanation, explanations that overlap with explanations of Step S101 to Step S110 and Step S201 to Step S208 for the fan device 2 of the first embodiment are simplified or omitted.

First, the signal of long press on the first switch 231 by a user is input (Step S101A), and the controller 24A receives the signal and turns on the drive 22 to make the drive 22 operate in the fluctuation mode (Step S102A).

Next, the controller 24A determines whether a signal of press on the first switch 231 is input (Step S103A). If the signal is not input (No in Step S103A), the controller 24A continues to make the drive 22 operate in the fluctuation mode until the signal is input.

If the signal is input (Yes in Step S103A), the controller 24A determines whether the signal is the signal of short press (Step S104A). If the signal is not the signal of short press, that is, if the signal is the signal of long press (No in Step S104A), the controller 24A turns off the drive 22 to terminate operation.

If the signal is the signal of short press (Yes in Step S104A), the controller 24A switches the mode of the drive 22 to the third mode (Step S105A).

Processing in the following Steps S106A to S113A is the same as the processing in Steps S103 to S110 of the first embodiment shown in FIG. 5. Explanation is omitted.

In the fan device 2A of the second embodiment, the case in which the second switch 232 is pressed is the same as processing in Steps S201 to S213 of the first embodiment shown in FIG. 5, except that, when the signal of short press on the first switch 231 is input after the driver 22 switched to the first mode, the controller 24A switches the mode of the drive 22 to the fluctuation mode instead of the third mode. Explanation is omitted.

As shown above, the fan device 2A of the second embodiment includes the fluctuation mode in which the air volume of the fan 21 is alternately switched between the third air volume and the fourth air volume which is smaller than the third air volume.

This makes a user keep feeling a temperature not so different from a temperature in a case where the third air volume is continued, while battery consumption of the drive 22 is suppressed.

Third Embodiment

The fan device 2B of the third embodiment will be described based on FIGS. 8 and 9. The same signs are given to the same components as those of the fan device 2 of the first embodiment. Explanation is omitted.

Figure 8:
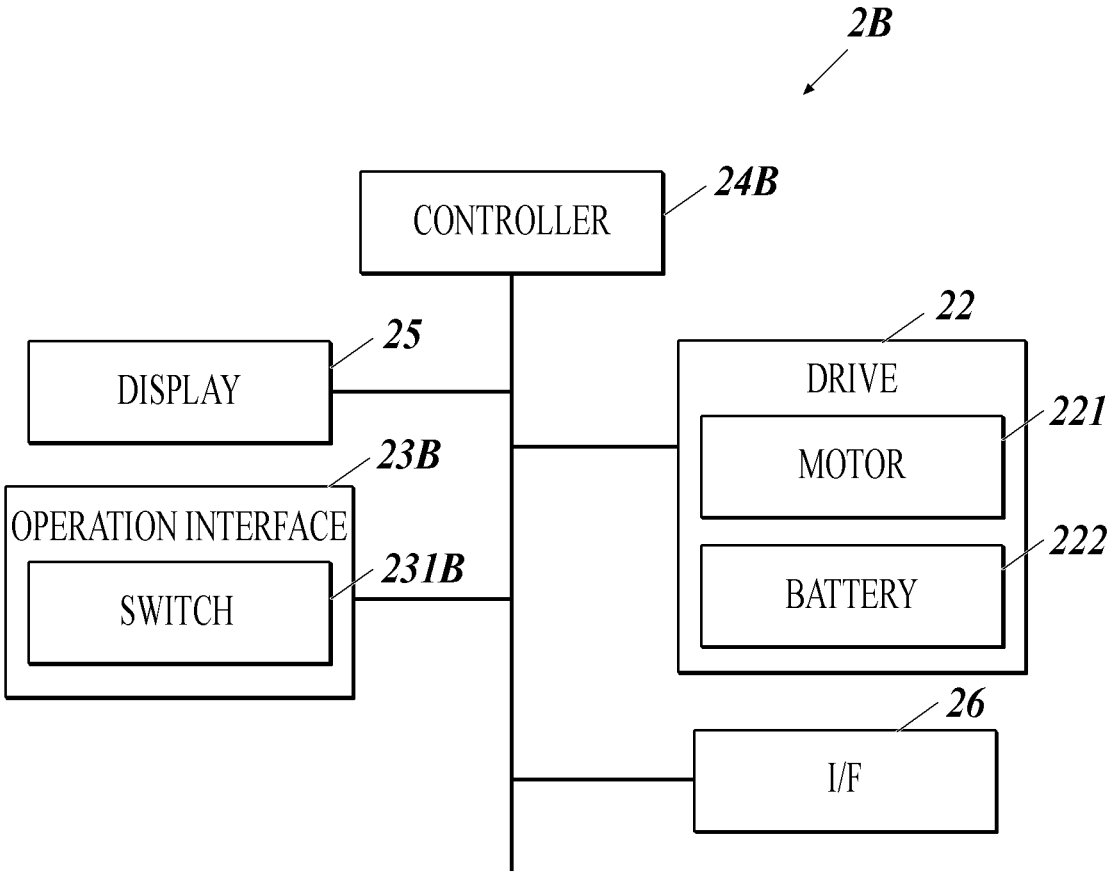
FIG. 8 is a block diagram showing functions of a fan device of the third embodiment.

As shown in FIG. 8, the fan device 2B of the third embodiment has a single switch 231B as the operation interface 23B.

Switch

Long press on the switch 231B turns on/off the drive 22. Short press on the switch 231B switches the mode of the drive 22. When the drive 22 is turned on, the controller 24B makes the drive 22 operate in the third mode. Every time the short press is performed on the switch 231B, the controller 24B cyclically switches the mode to the fourth mode, the fifth mode, the third mode, and so on.

Flow of Switching of Drive Status when Switch is Pressed

FIG. 9 is a flowchart explaining switching of modes in the fan device 2B of the third embodiment.

In the following explanation, explanations that overlap with explanations of Step S101 to Step S110 in FIG. 5 and Step S201 to Step S208 in FIG. 6 for the fan device 2 of the first embodiment are simplified or omitted.

First, the signal of long press on the switch 231B by a user is input (Step S101B), and the controller 24B receives the signal input from the switch 231B and turns on the drive 22 to make the drive 22 operate in the third mode (Step S102B).

Processing in subsequent Steps S103B to S110B is the same as that in Steps S103 to S110 shown in FIG. 5 except that the target for pressing by a user is not the first switch 231, but the switch 231B. Explanation is omitted.

Next, when the signal of short press on the switch 231B by a user is input while the drive 22 is in the fifth mode (Yes in Step S110B), the controller 24B determines whether the remaining amount of the battery 222 of the drive 22 is more than or equal to the predetermined amount (Step S111B). If the remaining amount of the battery 222 is less than the predetermined amount (No in Step S111B), the controller 24B switches the mode of the drive 22 to the third mode (Step S102B).

If the remaining amount of the battery 222 is more than or equal to the predetermined amount (Yes in Step S111B), the controller 24B determines whether a predetermined time has passed since the mode was switched to the second mode (Step S112B). If the predetermined time has not passed (No in Step S112B), the controller 24B switches the mode of the drive 22 to the third mode (Step S102B). If the predetermined time has passed (Yes in Step S112B), the controller 24B switches the mode of the drive 22 to the first mode (Step S113B).

Processing in subsequent Steps S114B to S119B is the same as that in Steps S208 to S213 of the first embodiment in FIG. 6 except that the target for pressing by a user is not the first switch 231, but the switch 231B. Explanation is omitted.

As described above, the fan device 2B of the third embodiment includes:

- the fan 21;
- the drive 22 that rotates the fan 21;
- the operation interface 23B for a user to switch the drive status of the drive 22; and
- the controller 24B that switches the drive status of the drive 22 based on operation on the operation interface 23B by a user.

The operation interface 23B includes a switch 231B for switching the air volume of the fan 21 between air volumes of several modes.

When the mode is switched to the first mode by the switch 231B, the controller 24B makes the drive 22 operate in the first mode. In the first mode, the air volume by the fan 21 is the first air volume which is maximum. After a predetermined period, the controller 24B makes the drive 22 operate in the second mode in which the air volume by the fan 21 is the second air volume. The second air volume is smaller than the first air volume and is different from the air volumes of the modes which can be switched.

Thus, the drive status of the drive 22 can be switched with the single switch 231B. This further reduces the number of components of the operation interface 23 and lowers manufacturing cost.

Fourth Embodiment

Figure 10:
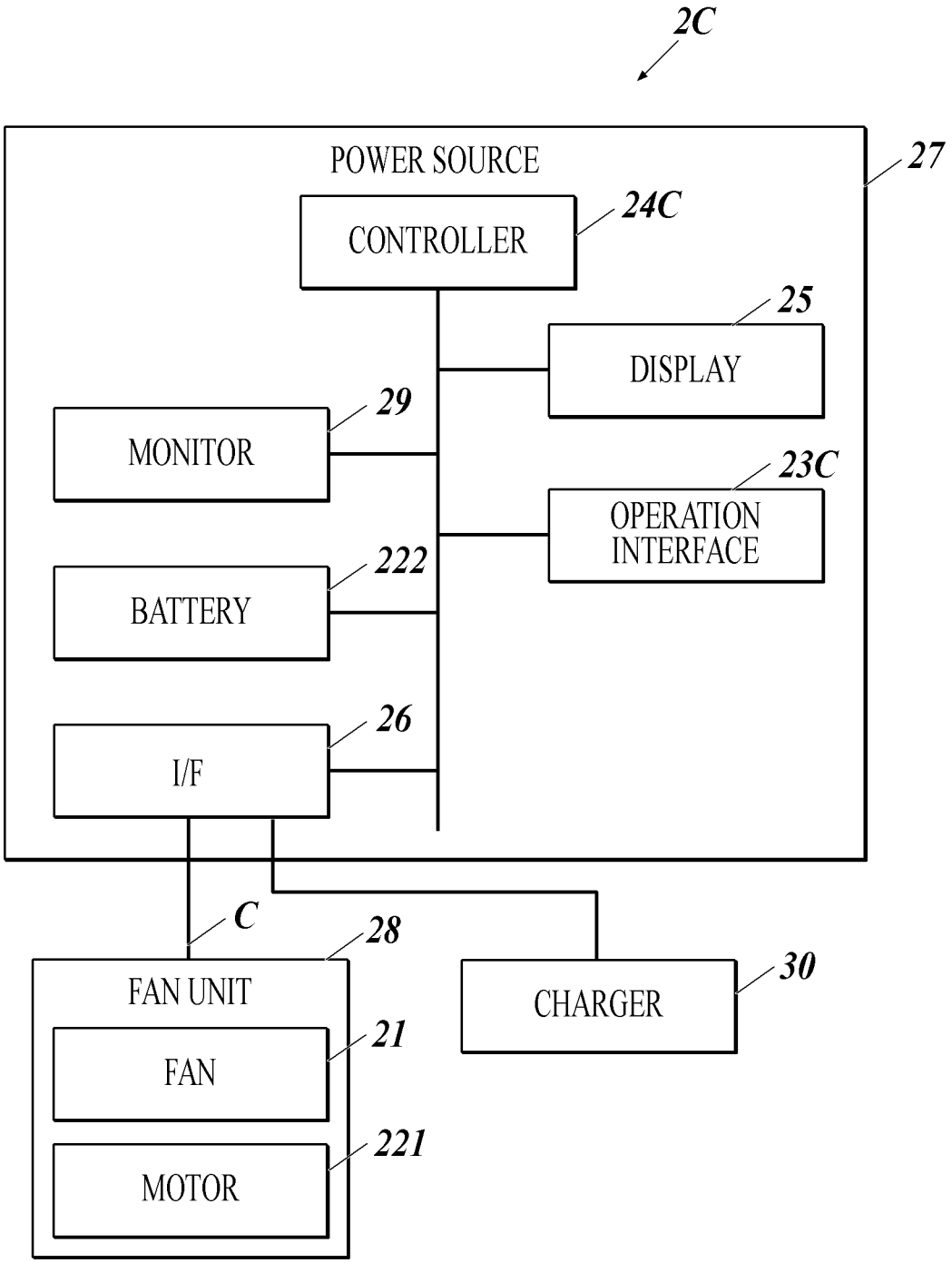
FIG. 10 is a block diagram showing functions of a fan device of the fourth embodiment.

The fan device 2C of the fourth embodiment will be explained based on FIG. 10.

The fan device 2C of the fourth embodiment shows an example in which the configuration of the fan devices 2 to 2B of the first to third embodiments is specifically configured by:

- a fan unit 28 including a fan 21 and a motor 221 for driving the fan 21;
- a power source 27 for driving the fan 21; and
- a connection (cable) 4 that connects the power source 27 with the fan unit 28.

In the following, the components with the same signs and names as those of the fan device 2 of the first embodiment have the same functions and effects.

The fan 21 includes, for example, a propeller housed in a case. The fan 21 is detachably mounted in the fan mount hole 13. The fan 21 includes a transmission mechanism (not shown) that transmits the rotational force of the motor 221 to the propeller.

The power source 27 includes:

- a battery 222 which applies a voltage necessary to drive the motor 221 and which consists of, for example, a lithium-ion cell;
- an operation interface 23C for inputting a signal to switch the drive status of motor 221;
- a monitor 29 that monitors over-charge, over-discharge, etc. of the battery 222;
- a controller 24C that performs:
  - protection of the power source 27 by the monitor 29; and
  - control of switching the drive status of the motor 221 in response to signals received from the operation interface 23C;
- a display 25 that shows control status of the controller 24C and the like; and
- an I/F (interface) 26 for connecting the device with the fan unit 28 via the cable C to control the motor 221 of the fan unit 28 and for connecting the device with the charger 30 to charge the battery 222.

The fan device 2C has the same functions as those of the fan devices 2 to 2B in the first to third embodiments, and achieves the same effects.

Modification

In the first and second embodiments above, the first switch 231 also serves as the power switch. The present invention is not limited to this. The first switch 231 and the power switch may be separate so that the operation interface 23 has three switches including the second switch.

The fan device 2B of the third embodiment has five modes, i.e., the first to the fifth modes, as in the fan device 2 of the first embodiment. The present invention is not limited to this. As with the fan device 2A of the second embodiment, the fan device 2B may have six modes including the fluctuation mode.

In the first to third modes, the second mode is set to have a larger air volume than those in the third to fifth modes. Alternatively, the air volume of the second mode may be an air volume between those of the third and fourth modes, an air volume between those of the fourth and fifth modes, or an air volume smaller than that of the fifth mode.

The fan devices 2, 2B in the first and third embodiments should have at least four modes, i.e., the first to fourth modes. The fan device 2A in the second embodiment should have at least five modes, i.e., the first to fourth modes and the fluctuation mode.

In the second embodiment, in order to simplify explanation, when the drive 22 is turned on, the drive 22 is made to operate in the fluctuation mode. The present invention is not limited to this. The drive 22 may be made to operate in modes other than the first and second modes and be switched to the fluctuation mode by short press on the first switch 231.

The display 25 shows the current mode of the drive 22. The present invention is not limited to this. For example, while the battery 222 is charged, the display 25 may indicate what percentage of the battery is currently charged.

Other specific detailed structures, etc. may be changed as appropriate.

What is claimed is:

1. A fan device attachable to a garment body, the fan device comprising:

a fan;

a drive that rotates the fan;

a first switch and a second switch that are operable by a user to switch a drive status of the drive; and a hardware processor that switches the drive status of the drive based on an operation of at least one of the first switch and the second switch by the user, wherein:

when the first switch is operated, the hardware processor controls the drive to sequentially switch an air volume of the fan between plural air volumes corresponding to multiple modes each time the first switch is operated, and when the second switch is operated, the hardware processor controls the drive to operate in a first mode in which the air volume of the fan is a first air volume which is larger than any of the plural air volumes that are switchable between by operation of the first switch, and after a predetermined period, the hardware processor controls the drive to operate in a second mode in which the air volume of the fan is a second air volume, the second air volume being a predetermined air volume which is smaller than the first air volume and which is different from the plural air volumes that are switchable between by operation of the first switch.

2. The fan device according to claim 1, wherein the first switch also serves as a power switch.

3. The fan device according to claim 1, wherein the hardware processor invalidates input to the second switch while controlling the drive to operate in the first mode.

4. The fan device according to claim 1, wherein the multiple modes include a fluctuation mode in which the air volume of the fan is alternated between a third air volume and a fourth air volume that is smaller than the third air volume.

5. The fan device according to claim 1, wherein:

the drive comprises a battery, and when the mode is switched to the first mode, the hardware processor controls the drive to operate in the first mode in a case where a remaining amount of the battery is at least a predetermined amount.

6. The fan device according to claim 1, wherein, when the mode is switched to the first mode, the hardware processor controls the drive to operate in the first mode again in a case where a predetermined time has passed since an end of a last control operation of the drive in the first mode.

7. A fan-equipped garment, comprising:

the fan device according to claim 1; and the garment body to which the fan device is detachably attached.

8. A fan device attachable to a garment body, the fan device comprising:

a fan;

a drive that rotates the fan;

a switch operable by a user to switch a drive status of the drive, the switch being operable to sequentially switch an air volume of the fan between plural air volumes corresponding to multiple modes; and a hardware processor that switches the drive status of the drive based on operation of the switch by the user, wherein:

when a mode is switched by operation of the switch to a first mode in which the air volume of the fan is a first air volume which is maximum, the hardware processor controls the drive to operate in the first mode, and after a predetermined period, the hardware processor controls the drive to operate in a second mode in which the air volume of the fan is a second air volume, the second air volume being a predetermined air volume which is smaller than the first air volume and which is different from the plural air volumes which are switchable between by operation of the switch.

9. A non-transitory recording medium storing a program for a computer of a fan device that is attachable to a garment body, wherein:

the fan device comprises:

a fan;

a drive that rotates the fan;

a first switch and a second switch that are operable by a user to switch a drive status of the drive; and a hardware processor that switches the drive status of the drive based on an operation of at least one of the first switch and the second switch by the user, and the program is executable to control the computer to:

control the drive to sequentially switch an air volume of the fan between plural air volumes corresponding to multiple modes each time the first switch is operated;

control the drive to operate in a first mode in a case where the second switch is operated, the first mode being a mode in which the air volume of the fan is a first air volume which is larger than any of the plural air volumes that are switchable between by operation of the first switch; and after a predetermined period, control the drive to operate in a second mode in which the air volume of the fan is a second air volume, the second air volume being a predetermined air volume which is smaller than the first air volume and which is different from the plural air volumes that are switchable between by operation of the first switch.

10. A non-transitory recording medium storing a program for a computer of a fan device that is attachable to a garment body, wherein:

the fan device comprises:

a fan;

a drive that rotates the fan;

a switch operable by a user to switch a drive status of the drive, the switch being operable to sequentially switch an air volume of the fan between plural air volumes corresponding to multiple modes; and a hardware processor that switches the drive status of the drive based on operation of the switch by the user, and the program is executable to control the computer to:

control the drive to operate in a first mode in which the air volume of the fan is a first air volume which is maximum, in a case where a mode is switched by operation of the switch to the first mode, and after a predetermined period, control the drive to operate in a second mode in which the air volume of the fan is a second air volume, the second air volume being a predetermined air volume which is smaller than the first air volume and which is different from the plural air volumes which are switchable between by operation of the switch.

* * * * *